US005638991A

United States Patent [19]

Todden et al.

[11] Patent Number: 5,638,991

[45] Date of Patent: Jun. 17, 1997

[54] BOTTLED WATER PUMPING AND DISPENSING APPARATUS

[76] Inventors: Terry J. Todden, 14548 Killion St., Van Nuys, Calif. 91411; Richard A. Thornberry, 15442 Vintage St., Mission Hills, Calif. 91345

[21] Appl. No.: 255,166

[22] Filed: Jun. 7, 1994

[51] Int. Cl.[6] ..... B65D 5/66

[52] U.S. Cl. ..... 222/113; 222/189.1; 222/146.1; 222/325; 222/375; 222/608

[58] Field of Search ..... 222/113, 190, 222/146.1, 146.5, 146.6, 375, 377, 382, 464, 608, 189, 325; 224/148; 280/33.98, 47.131, 42.27

[56] References Cited

U.S. PATENT DOCUMENTS

| | | | |
|---|---|---|---|
| 2,639,063 | 5/1953 | Yuza | 222/375 X |
| 4,174,743 | 11/1979 | Beny et al. | 141/18 |
| 4,456,149 | 6/1984 | Sciortino | 222/1 |
| 4,852,621 | 8/1989 | Bear | 141/83 |
| 4,958,747 | 9/1990 | Sheets | 222/67 |
| 5,154,317 | 10/1992 | Roppolo, III | 222/608 X |
| 5,184,476 | 2/1993 | Desrosiers et al. | 62/389 |
| 5,238,146 | 8/1993 | Thorne, Jr. | 222/382 X |
| 5,249,438 | 10/1993 | Rhaney et al. | 280/47.26 X |
| 5,259,215 | 11/1993 | Rocca | 280/47.26 X |

*Primary Examiner*—Gregory L. Huson

*Attorney, Agent, or Firm*—Macro-Search Corp.; Gene Scott

[57] ABSTRACT

A bottled water dispenser is similar in size to those available on the market today. An upright five gallon bottle slides onto a dolly and is held fast to the dolly by a stretch cord. The dolly with bottle is wheeled into the bottom of the dispenser. Alternately, the dispensing system may be assembled upon the dolly itself. A tube with a rubber stopper at one end and a check valve at the other end is inserted into the bottle. Pushing a button on the face plate of the dispenser cabinet activates an internal electric pump. The pump draws water from the bottle through the check valve and forces it out of the spigot under pressure. Internal solenoid valves force the water through a heating unit, cooling unit or filtration system before exiting through the spigot. Each temperature is achieved by pushing a different colored button on the face plate. The dispenser operates on 240 V AC, 120 V AC or 12 V DC. It has a built in auxiliary battery back up in the event of power outages or for portable use. The dispenser can be mobile on wheels, free standing, or built into a kitchen cabinet.

11 Claims, 5 Drawing Sheets

BOTTLED WATER PUMPING AND DISPENSING APPARATUS

FIELD OF THE INVENTION

The invention relates to drinking water dispensing units and more particularly to a dispenser for bottled water of the type supplied in five gallon containers for use in commercial and residential applications.

BACKGROUND OF THE INVENTION

With ever increasing pollution in the world today all water is adversely affected. Municipal water supplies are polluted wherein trace amounts of many toxins are found. These waters are typically filtered mechanically, and then treated with ammonia and chlorine to kill bacteria. As a result, these waters are marginally suitable for drinking and food preparation. In order to improve water of this type, typically a "point of use" filter system is attached to the plumbing under the sink or nearby the water supply. For renters, this usually involves getting owner's permission and paying an installation fee. The unit is usually left behind when the party moves. Use of community water supplies has the further drawback that in the event of an emergency water shutdown, the water supply is cut off.

Conventional bottled water dispensers raise many problems. Some people are discouraged from purchasing heavy five gallon bottles. The bottles are usually dragged across the floor then lifted, tamed upside down and positioned on top of the dispenser. To dispense water from the unit one has to stoop down. Furthermore, typical dispensers are considered unsightly. Maintenance raises further problems. The reservoir must be cleaned often. Any impurities in the bottle and dirt on the outside of the bottle neck enter the water supply. A breeding ground for bacteria is formed. Dispensing water from the inverted bottle allows air to pass through the water thus tainting it with bacteria and pollutants. Dispenser spigots have a mechanical rubber plunger inside which eventually wears out causing water leakage.

The prior art includes the following patents: U.S. Pat. Nos. 5,184,476 to Desrosiers et at., 4,958,747 to Sheets, 4,852,621 to Bear, 4,456,149 to Sciortino and 4,174,743 to Beny et al. These references disclose various water dispensers. However, the above enumerated problems are not solved by the prior art so that a simple and inexpensive bottled water dispenser is needed which solves these problems.

SUMMARY OF THE INVENTION

Accordingly, it is the object of the invention to overcome all the problems and shortcomings associated with present day bottled water dispensers. The bottled water dispenser according to the present invention is simple and inexpensive. A five gallon bottle sits in an upright position near or at floor level. The bottle is transported on a dolly which is wheeled into the dispenser. A tube is inserted into the bottle. The water in the bottle can be purified drinking water. The bottle can alternately be refilled with filtered or purified tap water. The dispenser has been designed to house any "state of the art" filtration device. The dispenser can be fully portable and mobile for either bottled water or filtered tap water. Changing an empty bottle for a full one or refilling it with tap water is easy and can be done by an unskilled person, a relatively weak adult or even a child.

The transport of the water bottle to and from the dispenser is easy accomplished through the use of a specially designed dolly. The dolly when placed into the dispenser tilts at an angle. This allows a pickup tube with check valve to draw up almost all the water in the bottle. The remaining few ounces which are not drawn up may contain sediment or impurities and is discarded.

All devices used in the heating, cooling and filtration along with all wiring and electronics are put in a sealed box type enclosure in the upper portion of the dispenser. Only the pick- up tube with stopper and check valve are suspended below the box. The remaining parts of the dispenser cabinet, i.e., sides, door, bottom and back, can be moved from one location to another quite easily as a unit. Such a dispenser is very portable, but it can be built into kitchen cabinets for use as a fixed appliance in houses, motor homes or boats.

People who move often or rent apartments and condominiums with security gates cannot always have five gallon bottles delivered to the door. Some suburbs and rural areas have no bottled water service. In these cases the dispenser bottle can be filled with tap water and then pressure fed through the filtration system. When bottled water is used, each new bottle is simply wheeled into the cabinet as necessary without the need to lift the heavy bottle of water.

An energy efficient cooling and heating system is also provided in the instant invention. Current dispensers with heating and cooling systems have two reservoirs. The hot water reservoir sits below the cold water reservoir. The heat produced rises thus warming the cold water reservoir. This in turn causes the cooling compressor to work harder to cool the water. In contrast, the cooling tank, compressor and hot water tank in the present dispenser are placed with insulation so that the transfer of heat is minimized.

The dispenser is adapted to operate on multiple voltages. In the U.S. and Canada 120 V AC can be used. In Europe 240 V AC can be used. In motor homes or boats either 120 V AC or 12 V DC can be used. For portable or mobile use the auxiliary back up battery is employed. This has also a special advantage in case of power outages. A receptacle for the respective voltage can be placed in the upper back portion of the dispenser. This is provided for the use of coffee makers, blenders or any small appliance that can be placed on the top of the dispenser.

A 12 V DC light is built into the dispenser. The light is placed behind and above the area where the bottle sits. The light is activated by opening the door to the dispenser. The light illuminates the water bottle for easy visual inspection of the water level. In the event of a power outage, emergency illumination is provided by opening the door of the dispenser. By placing the bottle on the bottom, the center of gravity of the dispenser is lowered. It is less likely that the dispenser will tip over in the event of an earthquake or any strong blow to the side panel of the unit.

Since the bottle sits in an upright position any particles or impurities in the water, especially from tap water, will sink to the bottom of the bottle. This is in contrast to the conventional top loading dispensers in which the impurities sink to the bottom of a reservoir from which the water is drawn. As water is drawn from the bottle, air must enter the bottle to equalize pressure. This is accomplished by an activated charcoal air inlet filter placed into a small hole in the rubber stopper. All air entering the bottle is filtered from dust, bacteria, and air pollutants. The dispenser has no reservoirs, valves, hoses or drip trays to clean.

Current systems have a mechanical rubber type valve built into the spigot. After repeated use the valve can leak or stick open thus emptying all the dispenser content onto the floor. In contrast, the spigot used in the present water dispenser contains no valves. It is angled upward to allow the water to flow backwards into the pump after water is dispensed. It houses two or more fine mesh screens in a screw type housing located at the output tip of the spigot. The pump or output valves shut off after water is dispensed. The few droplets of water, that would drip out of the spigot, are retained onto the screens. This eliminates the need for a drip tray.

Current gravity fed water dispensers are slow in discharging water from the spigot. The present water dispenser utilizes an inexpensive non-self priming high output pump. The pump is positioned at a specific angle and can be easily primed from the spigot. Therefore, the pump operates like a self priming pump. The non-self priming pumps are quiet, vibration free and can be run dry. They do not break apart leaving rubber particles in the water system. These pumps produce high output for their size which makes them ideal for sending pressurized water through a filtration system.

The pump must be primed only upon initial use. In one embodiment the water outlet spigot is removed and replaced with a priming elbow. The elbow resembles the output spigot but does not house screens. The elbow extends upwardly. A specified amount of water can be poured in, to fill the inlet tube and pump. The priming elbow is then removed and replaced with the outlet spigot which, of course, dispenses downwardly.

In another embodiment, an auxiliary self priming pump is connected in series with the output side of the non-self priming high output pump. Upon pushing a priming button on the dispenser, the self priming pump is activated. It draws water from the bottle through the check valve and tube, and through the non-self priming pump. The button is released and the non self priming pump is now primed. The check valve prevents water from flowing back into the water bottle. The self priming pump is used only once for the priming of the non-self priming pump. Once the dispenser is primed there is no need to prime it again unless the check valve is pushed open and water is released from the non-self priming pump. The self priming pump can be also used as a back-up pump if the non-self priming pump fails.

One or more bottles may be used in cabinets designed to accommodate such further supplies of water for the situation where water is consumed at a higher rate. Thus bottles may be changed less frequently. The additional bottles are all connected one to the other using tee connectors. However, all the bottles have their own pickup tubes and check valves. Several small appliances such as a coffee maker, blender or microwave oven can be placed on the top surface of a wider cabinet.

BRIEF DESCRIPTION OF THE DRAWINGS

The accompanying drawings illustrate the invention. In such drawings.

DETAILED DESCRIPTION OF THE PREFERRED EMBODIMENT

Figure 1:
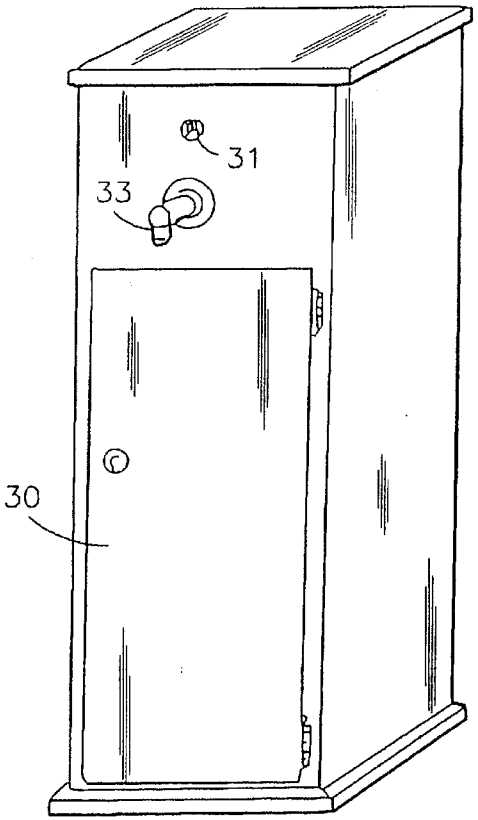
FIG. 1 is an isometric view of the bottled water dispenser of the instant invention.

FIG. 1 is a front view of the bottled water dispensing system. A water bottle 10 is supporting for transport on a transport means 11 such as a transport dolly which includes an upward facing surface 11A for supporting the water bottle 10, which is thence moved into a cabinet 40 of the dispensing system through a cabinet door 30. The cabinet 40 contains a 12 V DC light such as LP1 of FIG. 6, which turns on when the door 30 is opened. The light LP1 illuminates the bottle 10 for a visual inspection of the water level. LP1 can also be used as emergency lighting. The push button switch 31 activates a pump 42. A spigot means such as a water outlet spigot 33 houses two fine mesh screens (not shown) to prevent drips.

Figure 2:
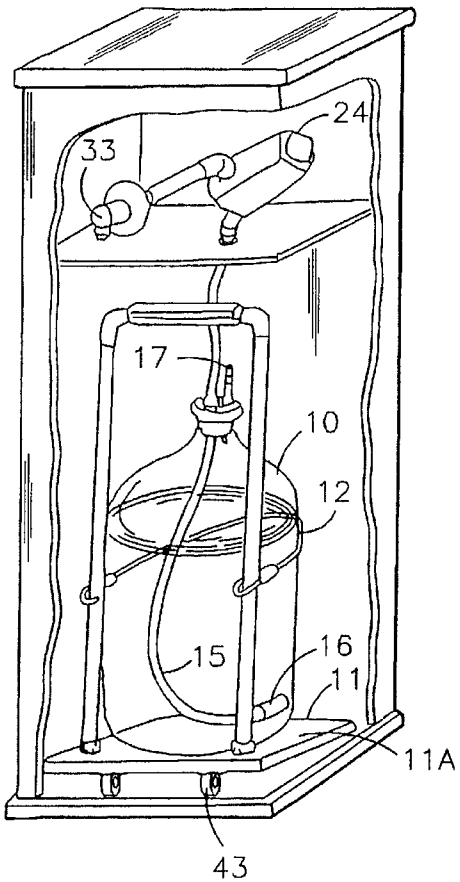
FIG. 2 is a view similar to FIG. 1 with the cabinet cut-away to show interior features.

FIG. 2 is a cutaway front view of the bottled water dispenser—room temperature model. The water dispenser uses supply of water 13, such as from the water bottle 10. A pump means such as pump 24 is activated by the user for delivering water to the spigot 33. The transport dolly 11 carries the bottle 10 and holds it on an incline, so as to develop a lowest point 9 in the bottle 10. A tube means 15 such as a PVC flexible tube carries the water supply from the bottle 10 to the pump 24 and is fitted so as to apply pump suction to the lowest point in the bottle 10. This allows all but a very small amount of the water supply to be drawn by the pump 24. The bottle 10 is slid onto the transport dolly 11 and then wheeled into the dispenser. The dolly 11 has a generally upwardly facing surface for supporting the bottle 10 thereon. A pair of wheels 43 supports the dolly 11 for rolling on a support surface and enabling the upwardly facing surface to be rested at a non-horizontal orientation. The bottle 10 is held fast onto the dolly 11 by a support means 12 such as a flexible, elongate stretch cord. The bottom of the dolly 11 contacts a small wheel such as 44 of FIG. 4, attached to the base of the cabinet. This aids the dolly 11 in sliding into the cabinet. The cabinet integrally supports the spigot 33 and pump 24, and removably encloses the dolly 11.

The outlet spigot 33 is removed and replaced with a right angle priming elbow (not shown) upon initial use. A specified amount of water is poured into the priming elbow. It passes to the pump 14 through the pump feed tube 15 and is prevented from running into the bottle by the one way check valve 16. The priming elbow is then replaced by the outlet spigot 13. The check valve 16 is fitted at the lowest point in the bottle 10. Upon depressing the dispenser button, such as 31 of FIG. 1, water is dispensed. As water is drawn from the bottle 10, air enters the bottle 10 by passing through the charcoal filter 17.

The pump 24 is placed at an elevation below the spigot 33. The pump 24 is primed. Due to the one way operation of the check valve 16 at the end of the tube 15, a portion of water always remains in the pump 24 after dispensing. The angle in which the non-self priming pump 24 is positioned may be critical. For example, one common pump used in pre-production units has to be positioned at an angle of approximately 45 degrees in relation to the horizontal and vertical planes.

Manual priming can be also accomplished. A hand pump or syringe (not shown) is connected to the water supply tubing either on the input or output side of the water pump 24, by means of a tee. This allows either sucking or forcing under pressure of the water through the pump 24, if connected to the output or input side of the pump 24 respectively. One check valve 16 is used on the inlet tube that is placed in the water bottle 10. Another check valve may be used on the outlet tube just before the spigot 33. By retracting the syringe plunger, a vacuum is formed in the tubing. This opens the check valve 16 in the water bottle 10 allowing water to enter the tubing. By pushing the syringe plunger inward, air is forced out of the other check valve at the spigot 33. This pumping action of the syringe is continued until water is either sucked or pushed through the pump 24.

Figure 3:
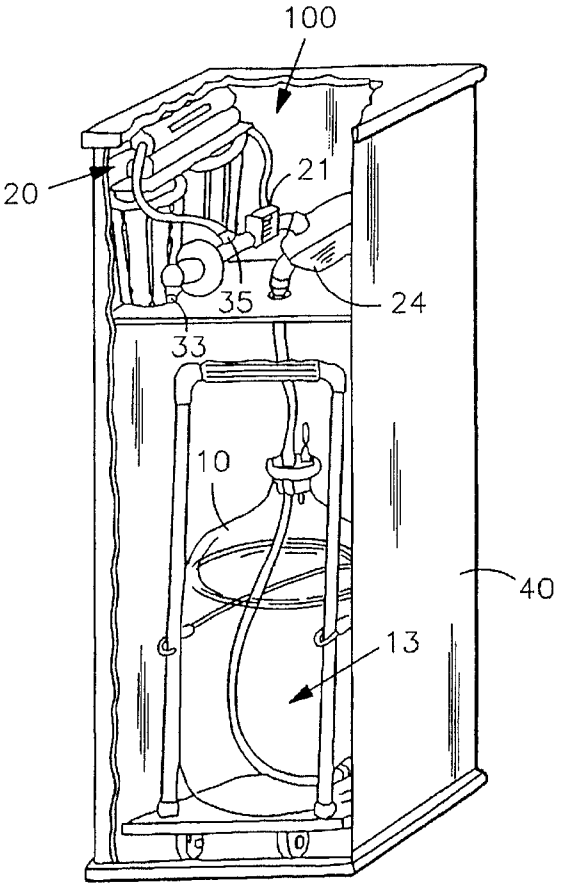
FIG. 3 is a view similar to FIG. 2 showing further features including water filtration units.

FIG. 3 shows the dispenser fitted with a water filtration system 20 for use with tap water or bottled water. Upon depressing the dispensing button, such as 31, the filter inlet solenoid 21 is activated along with the pump 24. Water is forced into the filtration system 20 under pressure by the pump 24. It exits the filtration system 20 passing through the one way check valve 16 into a tee connector and comes out of the spigot 33. The filtration system 20 could just as easily represent a cooling or heating device through which the water supply is forced for conditioning the water supply. In fact, any form of water conditioning including softening, sweetening, flavoring and other possibilities are represented in FIG. 3.

Figure 4A:
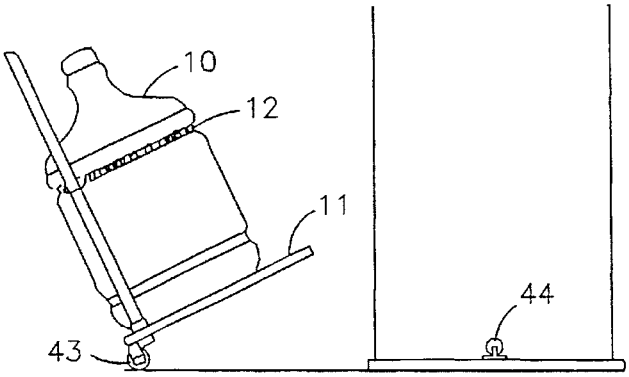
FIGS. 4*a*, 4*b* and 4*c* show schematically the use of a transport dolly of the invention.
Figure 4B:
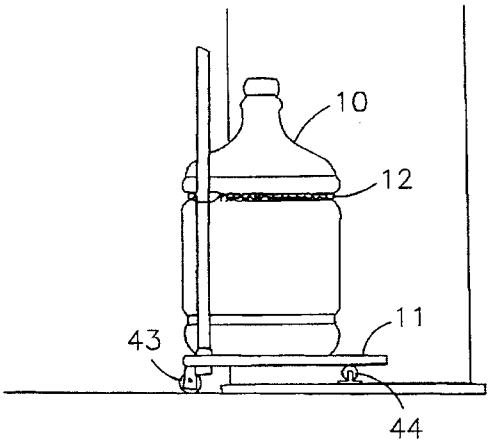
Figure 4C:
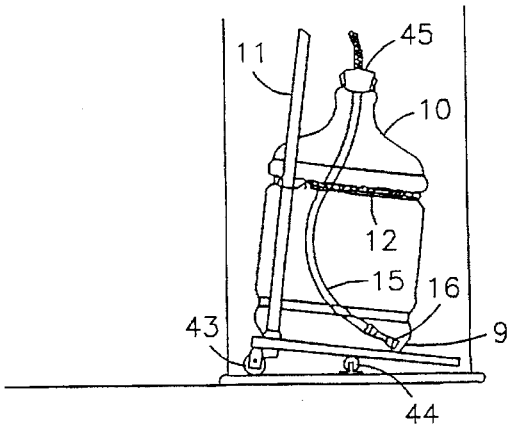
Figure 5A:
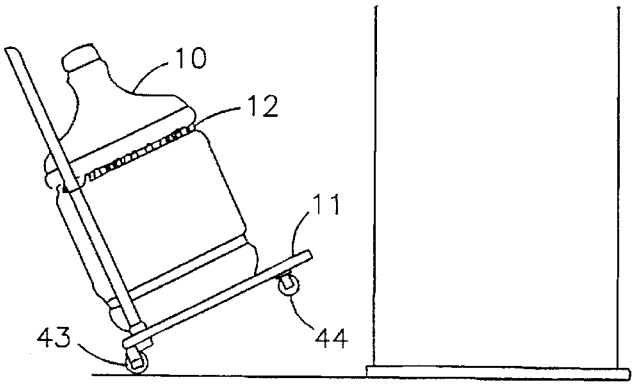
FIGS. 5*a*, 5*b* and 5*c* are similar to 4*a*, 4*b*, and 4*c* respectively showing an alternate transport dolly.
Figure 5B:
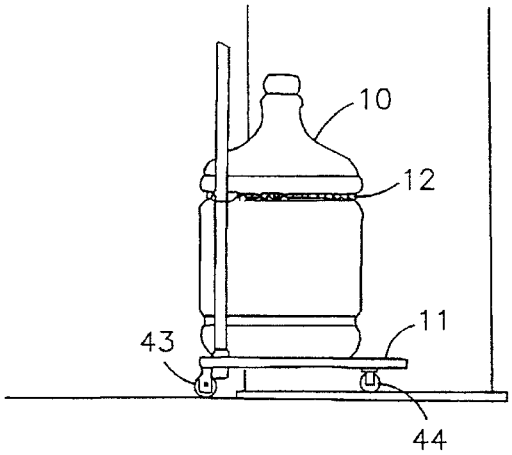
Figure 5C:
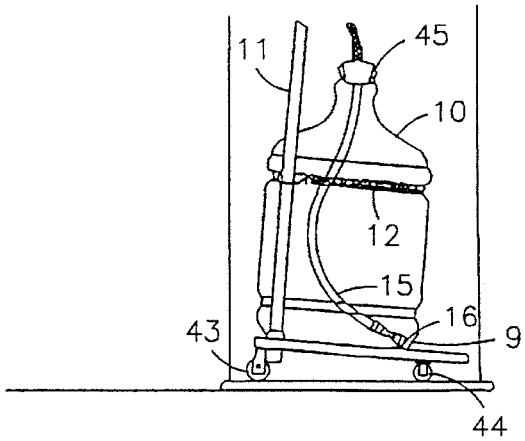

FIGS. 4*a*, 4*b* and 4*c* show the method of use of the transport dolly 11 for placing the water bottle 10 inside the dispenser. The dispenser is free standing or built into a kitchen cabinet. FIG. 4*a* shows the bottle 10 transported to the dispenser. FIG. 4*b* shows the bottom of the transport dolly 11 contacting an inverted glide wheel 44 affixed to the center of the cabinet floor. FIG. 4*c* shows the bottle 10 on top of the transport dolly 11 inclined at a proper angle within cabinet. The check valve 16, pump feed tube 15 and stopper 45 are inserted in the bottle 10. FIGS. 5*a*, 5*b* and 5*c* show the method of use of the transport dolly 11 for placing the water bottle 10 inside the dispenser when the transport wheels are all attached to the transport dolly 11.

Figure 6:
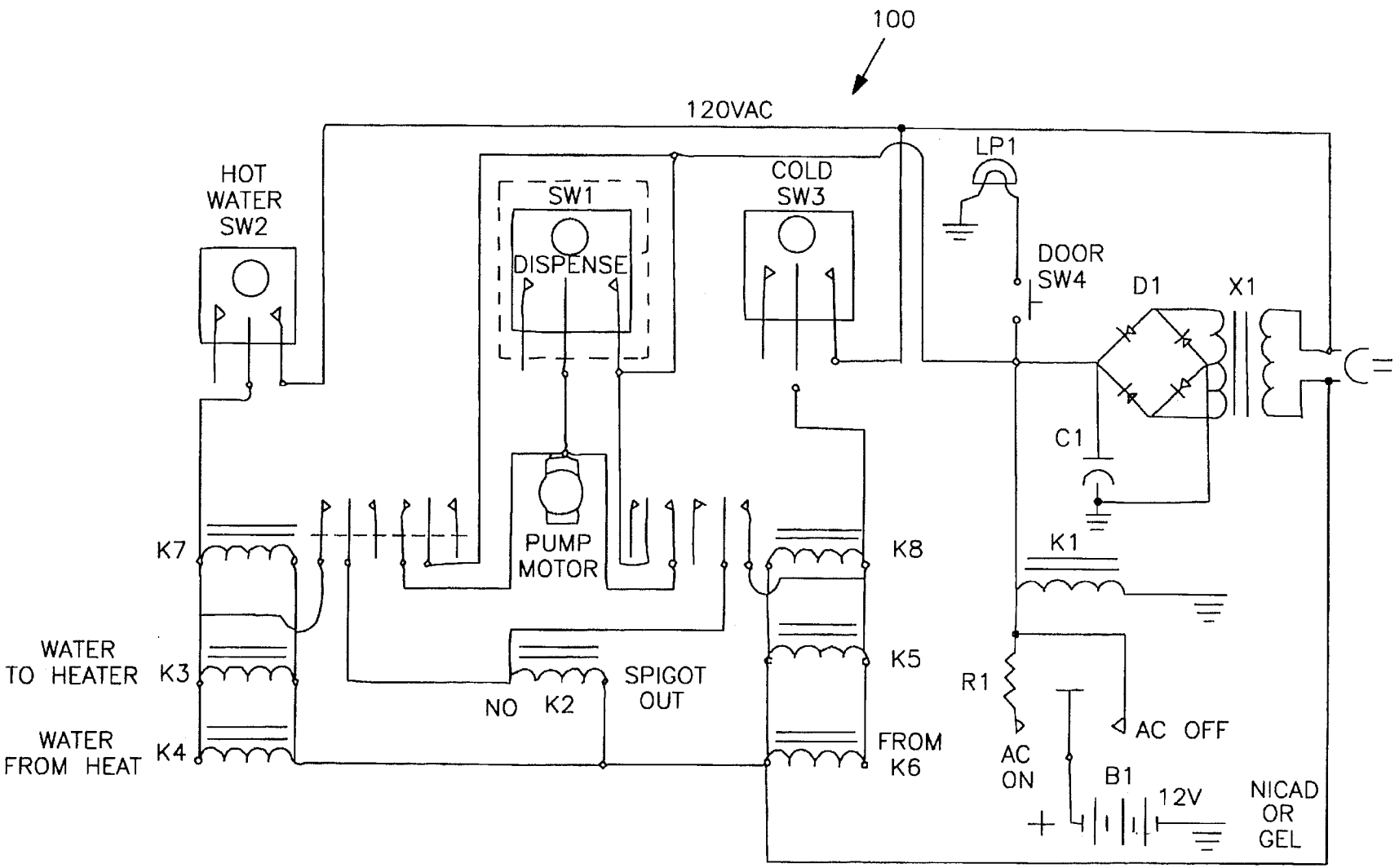
FIG. 6 is an electrical schematic of the instant invention.

FIG. 6 is an electrical schematic showing an electrical circuit 100 for hot, cold and room temperature models of the dispenser. The transformer X1 is connected to the full wave bridge rectifier D1 and further electrolytic capacitor C1. By these means 120 V AC is converted into 12 V DC. A plunger or micro switch SW4 is activated by the cabinet door, such as 30 of FIG. 1. A 12 V DC light LP1 is activated by the switch SW4. The light LP1 is used for a visual inspection of a water level in the water bottle and for an emergency lighting. The 12 V DC relay K1 is connected across the capacitor C1. When the voltage reaches approximately 12 V DC, the relay K1 turns on. The battery B1 is of the nickel cadmium type or gel cell battery connected to the capacitor C1 and charged through the resistor R1. If the supply voltage across the capacitor C1 drops, the relay K1 turns off and the battery B1 provides the 12 V DC supply voltage.

The push button micro switches SW1, SW2 and SW3 are for room temperature, hot and cold dispensing respectively. However, the hot and cold type dispensers do not require the switch SW1 as the motor pump is activated by the switches SW2 and SW3. The motor pump is included in a water treatment module for conditioning the supply of water. The module includes a plug-in attachment for mechanical and electrical interconnection with the dispenser. The attachment includes a water heater, cooler and filter. The switch SW2 activates the relay K7 and solenoids K3 and K4. The 120 V AC solenoids K3 and K4 control normally closed valves to and from the water heater respectively. Similarly, the switch SW3 activates the relay K8 and solenoids K5 and K6. The 120 V AC solenoids K5 and K6 control normally closed valves to and from the water cooler respectively. The 120 V AC relays K7 and K8 each activates the pump motor and the 120 V AC pump solenoid K2. The solenoid K2 controls a normally open valve of the spigot.

The dispensing switches SW1, SW2 and SW3 are mounted on the from of the dispenser. Upon depressing the room temperature button SW1, water exits the pump to the spigot 33. Upon depressing the hot button SW2, the pump solenoid K2 is activated as to prevent water from passing through it. The water is routed to the hot water intake solenoid valve which is also activated. The water passes through it and enters into the bottom of the heat tank. Hot water then passes out of the top of the heat tank and then to the hot water output solenoid valve which is also activated. The water passes through it to a tee connector and comes out of the spigot 33.

Upon depressing the cold button SW3, the pump valve is activated as to prevent water from passing through it. The water is routed to the cold water intake solenoid valve which is also activated. The water passes through it and enters into the bottom of the cooling tank. Cold water then passes out of the top of the cooling tank and then to the cold water output solenoid valve which is also activated. The water passes through it to the tee connector and comes out of the spigot 33.

Figure 7:
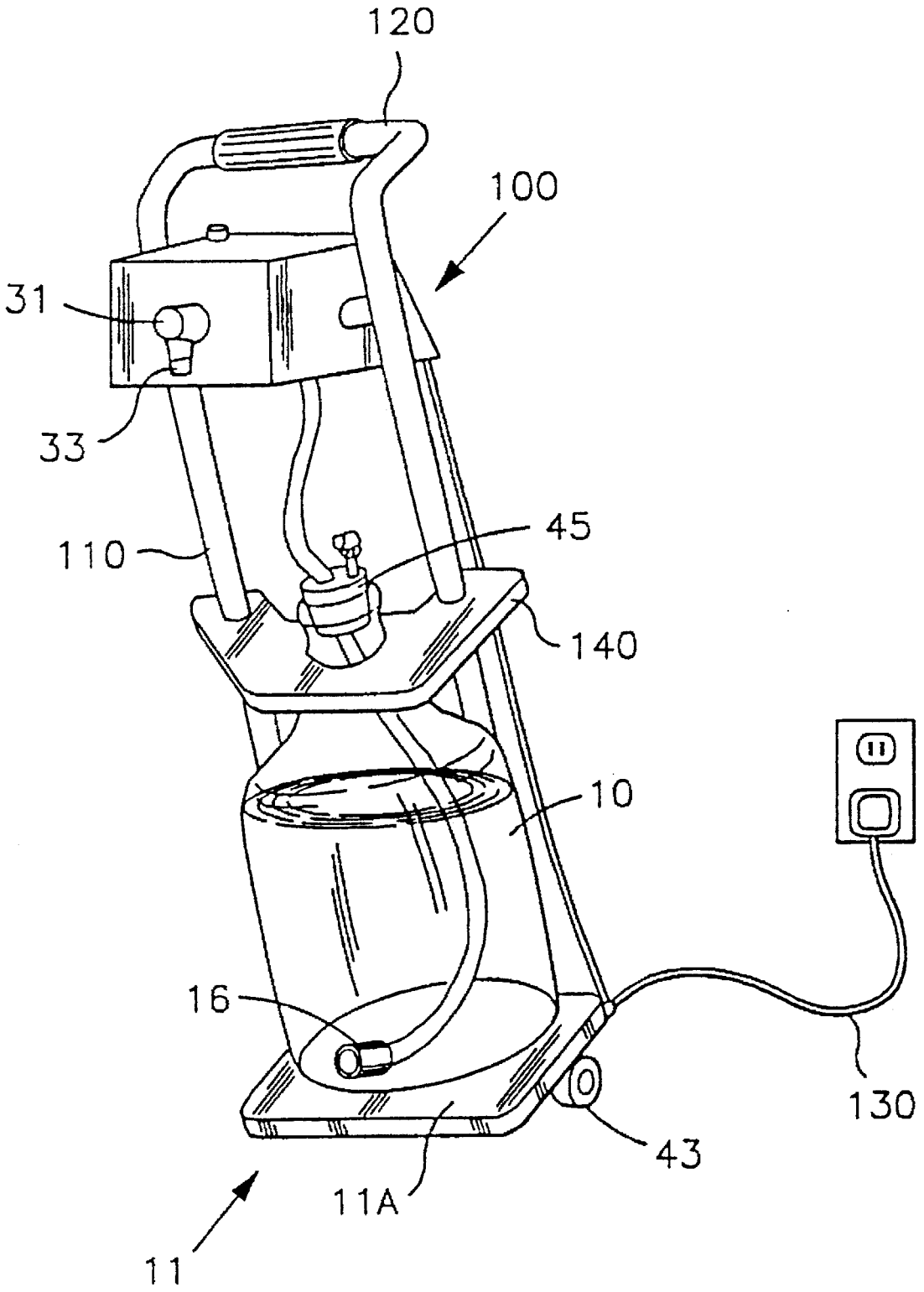
FIG. 7 is an isometric view of an alternate embodiment of the invention showing the critical components of the invention of FIG. 1 as mounted onto the dolly as a self-contained unit.

FIG. 7 is an isometric view of a preferred embodiment of the bottled water dispensing system of the present invention. In this embodiment the apparatus is conceived as a self contained portable unit capable of being wheeled to a site for use. A battery backup is provided to allow the apparatus to be used when AC power is not available. A water bottle 10 is supported for transport on a transport means 11 such as a transport dolly which includes an upward facing surface 11A for supporting the water bottle 10. The dolly includes a vertical support means 110 such as a pair of upwardly extending arms attached at one end of each of the arms to the surface 11A and joined at the other ends respectively to form a handle 120. A console 100A is supported by the support means 110 at a position near the handle 120. The console 100A contains electric circuit 100 and provides, external to the console 100A, a push button switch 31 which is engaged so as to activate pump 24. An AC power cord and plug 130 extend from the electric circuit 100 to any common AC outlet socket. A collar 140 is fitted for engaging the support means 110 and for engaging the water bottle 10 so as to hold the water bottle 10 on the surface 11A and in a generally upright position. The transport means 11 includes a pair of wheels 43 mounted thereunder in such a position as to assure that the surface 11A is tilted away from a horizontal position when the transport means 11 is at rest. The water bottle 10 is therefore positioned so that the water will drain to one side of the bottle 10 as the water is drawn toward the bottom of the bottle 10. The check valve 16 is also positioned at the low end of the bottle 10 so as to be able to suck-up the last portions of water in the bottom of the bottle 10.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense except by the following claims.

What is claimed is:

1. A bottled water pumping and dispensing apparatus system for use with a water bottle holding a supply of water comprising:

a spigot means for dispensing the supply of water;

a pump means for delivering the supply of water to the spigot means;

an electrical circuit including the pump means, means for transforming 120 V AC current to a low voltage DC, backup DC storage battery means, at least one push button micro switch for dispensing water, a plurality of electric valves and a plurality of relays interconnected for moving water through a water heater means, water cooler means and water filter means, the circuit interconnected such that the at least one push button micro switch activates appropriate ones of the electric valves and relays and the pump means for dispensing selected hot, cold, or room temperature amounts of the water supply;

the pump means being a non-self-priming pump set and mounted at a selected fixed angle such that an outlet of the pump is positioned above an inlet of the pump, the pump thereby maintaining prime when not pumping;

a transport means for carrying the water bottle, the transport means adapted by having at least one transport wheel set in an off-center position for holding the water bottle on an incline, so as to develop a lowest point in the water bottle; and a tube means for carrying the supply of water to the pump means and fitted at the lowest point in the water bottle, so as to allow most of the supply of water in the water bottle to be drawn by the pump means.

2. Water dispenser of claim 1 wherein the pump means is placed at an elevation below the spigot means, and wherein the tube means includes a check valve, such that a portion of the supply of water always remains in the pump means after dispensing to avoid the need for repeated priming of the pump means.

3. Water dispenser of claim 1 wherein the transport means includes a generally upwardly facing surface for supporting the water bottle thereon, and at least one wheel for rolling the transport means on a support surface and for enabling the upwardly facing surface to be rested at a non-horizontal orientation.

4. Water dispenser of claim 1 further including a cabinet for integrally supporting the spigot means and pump means, and for removably enclosing the transport means behind a door in the cabinet.

5. Water dispenser of claim 1 wherein the dispenser includes water conditioning means taken from the group of conditioning means including water heating means, water cooling means and water filtering means to provide purity and temperature conditioning to the supply of water.

6. Water dispenser of claim 1 further including a battery means and a light means for providing visual inspection of the supply of water in the water bottle, the light means being activated upon opening of the door.

7. A combination water dispenser and water bottle support and transport system comprising:

a spigot means for dispensing a supply of water, the spigot means interconnected with;

a pump means for delivering the supply of water to the spigot means;

an electrical circuit including the pump means, means for transforming 120 V AC current to a low voltage DC, backup DC storage battery means, at least one push button micro switch for dispensing water, a plurality of electric valves and a plurality of relays interconnected for moving water through a water heater means, water cooler means and water filter means, the circuit interconnected such that the at least one push button micro switch activates appropriate ones of the electric valves and relays and the pump means for dispensing selected hot, cold, or room temperature amounts of the water supply;

the pump means being a non-self-priming pump set and mounted at a selected fixed angle such that an outlet of the pump is positioned above an inlet of the pump, the pump thereby maintaining prime when at rest;

a transport means for supporting the water bottle, the spigot means, the electric circuit, and the pump means, the transport means adapted by having at least one transport wheel set in an off-center position for holding the water bottle on an incline, so as to develop a lowest point in the water bottle; and a tube means for carrying the supply of water from the water bottle to the pump means and fitted at the lowest point in the water bottle, so as to allow most of the supply of water in the water bottle to be drawn by the pump means.

8. Water dispenser of claim 7 wherein the pump means is placed at an elevation below the spigot means, and wherein the tube means includes a check valve, such that a portion of the supply of water always remains in the pump means after dispensing to avoid the need for repeated priming of the pump means.

9. Water dispenser of claim 7 wherein the transport means includes a generally upwardly facing surface for supporting the water bottle thereon, and at least one wheel for rolling the transport means on a support surface and for enabling the upwardly facing surface to be rested at a non-horizontal orientation.

10. Water dispenser of claim 7 wherein the dispenser includes water conditioning means taken from the group of conditioning means including water heating means, water cooling means and water filtering means to provide purity and temperature conditioning to the supply of water.

11. The water dispenser of claim 7 wherein the transport means includes an upward facing surface for supporting the water bottle and a pair of upwardly extending arms attached at one end of each of the arms to the surface and joined at the other ends respectively to form a handle, and further including a console for enclosing the electric circuit, the console supported by the support means at a position near the handle, and further including an AC power cord and plug extending from the electric circuit, and a collar fitted for engaging the support means and for engaging the water bottle so as to hold the water bottle on the surface in a generally upright but tilted position, the transport means including a pair of wheels mounted thereunder in an off-center position as to assure that the surface is tilted away from a horizontal position when the transport means is at rest, the water bottle therefore positioned so that the water will drain to one side of the bottle as the water is drawn toward the bottom of the bottle.

* * * * *